US011286589B2

(12) United States Patent
Lin

(10) Patent No.: US 11,286,589 B2
(45) Date of Patent: Mar. 29, 2022

(54) WOVEN TEXTILE

(71) Applicant: Ping-Kun Lin, Changhua County (TW)

(72) Inventor: Ping-Kun Lin, Changhua County (TW)

( * ) Notice: Subject to any disclaimer, the term of this patent is extended or adjusted under 35 U.S.C. 154(b) by 140 days.

(21) Appl. No.: 16/822,850

(22) Filed: Mar. 18, 2020

(65) Prior Publication Data

US 2020/0216986 A1 Jul. 9, 2020

Related U.S. Application Data

(63) Continuation-in-part of application No. 15/646,676, filed on Jul. 11, 2017, now abandoned.

(51) Int. Cl.
*D03D 11/02* (2006.01)
*D04C 1/00* (2006.01)
*D03D 17/00* (2006.01)

(52) U.S. Cl.
CPC ..... *D03D 11/02* (2013.01); *D03D 17/00* (2013.01); *D04C 1/00* (2013.01)

(58) Field of Classification Search
USPC ..... 139/329, 411, 425 A, 383 A; 28/155; 442/229, 205
See application file for complete search history.

(56) References Cited

U.S. PATENT DOCUMENTS 9,163,341 B2 * 10/2015 Nelis ..... A61L 17/04
2005/0247367 A1 * 11/2005 Debaes ..... D03D 27/06 139/327

FOREIGN PATENT DOCUMENTS

CN 103285486 A 9/2013

OTHER PUBLICATIONS

Office Action dated Sep. 1, 2021 in CN Application No. 201910135653.3, 8 pages.

* cited by examiner

*Primary Examiner* — Lynda Salvatore
(74) *Attorney, Agent, or Firm* — Muncy, Geissler, Olds & Lowe, P.C.

(57) ABSTRACT

The woven textile has a first end and an opposite second end. A longitudinal direction is defined by the first end and the second end. The woven textile includes an upper layer, a lower layer, and at least one binding thread. The upper layer includes at least one first braid woven by a plurality of filaments and extending in a meandering way to form a plurality of hollow portions. The lower layer includes at least one second braid woven by a plurality of filaments and extending in a meandering way to form a plurality of hollow portions. The binding thread fixes the first braid and the second braid together by weaving so that the upper layer and the lower layer are positioned by the binding thread.

4 Claims, 4 Drawing Sheets

WOVEN TEXTILE

BACKGROUND OF THE INVENTION

Field of the Invention

The present invention is a CIP of application Ser. No. 15/646,676, filed Jul. 11, 2017, the entire contents of which are hereby incorporated by reference.

Description of the Prior Art

Woven textile is used widely. For example, clothes, shoes, and daily commodities are often made by woven textile. However, how the woven textile is woven, the material, and the design determine the characteristics of the woven textile.

Conventional woven textile is woven by a single thread. Thus, the process of weaving is complicated, and the structure is easy to break down. Besides, the thickness of the woven textile is difficult to be increased. To increase the thickness, wider thread is usually used, or the thread is woven more times. If wider thread is used, the woven textile may be too heavy. If the thread is woven more times, the process may be time-consuming, and the air-permeability is bad.

On the other hand, two sides of conventional woven textile are made of the same material to have the same color and the same design.

Patent publication US 2005/0247367 disclosed a two-layer woven textile. However, each of the layers is actually an independent woven textile woven by warp threads and weft threads. Thus, the structure and the process of manufacture are both complicated. At least 5 kinds of threads have to be prepared.

In addition, the woven textile woven in conventional ways cannot provide larger meshes. The mesh is usually enlarged by skipping so that the structure of the woven textile is weakened.

SUMMARY OF THE INVENTION

The main object of the present invention is to provide a woven textile having better elasticity and being stereoscopic. In addition, the air permeability is improved, and the woven textile can be designed in various ways.

To achieve the above and other objects, the woven textile of the present invention defines an imaginary plane and has a first end and an opposite second end. A longitudinal direction parallel to the imaginary plane is defined by the first end and the second end. The woven textile further defines a horizontal direction which is parallel to the imaginary plane but perpendicular to the longitudinal direction. The woven textile includes an upper layer, a lower layer, and at least one binding thread.

The upper layer includes at least one first braid. The first braid is woven by a plurality of filaments. The at least one first braid has a plurality of first crests and a plurality of first trough arranged alternately along the horizontal direction. The first crests are closer to the first end than the first troughs are, and the first troughs are closer to the second end than the first crests are. The at least one first braid forms a plurality of hollow portions among the first crests and the first troughs. The upper layer and the lower layer are located at two opposite sides of the imaginary plane and are stacked along a vertical direction perpendicular to the imaginary plane. The lower layer includes at least one second braid. The second braid is woven by a plurality of filaments. The at least one second braid has a plurality of second crests and a plurality of second trough arranged alternately along the longitudinal direction. The second crests are closer to the first end than the second troughs are, and the second troughs are closer to the second end than the second crests are. The at least one second braid forms a plurality of hollow portions among the second crests and the second troughs. The binding thread fixes the first braid and the second braid together by weaving so that the upper layer and the lower layer are connected and fixed by the binding thread.

Thereby, the woven textile of the present invention having two independent layers has a larger thickness and elasticity. In addition, a gap between the two layers provides cushion and air-permeability.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
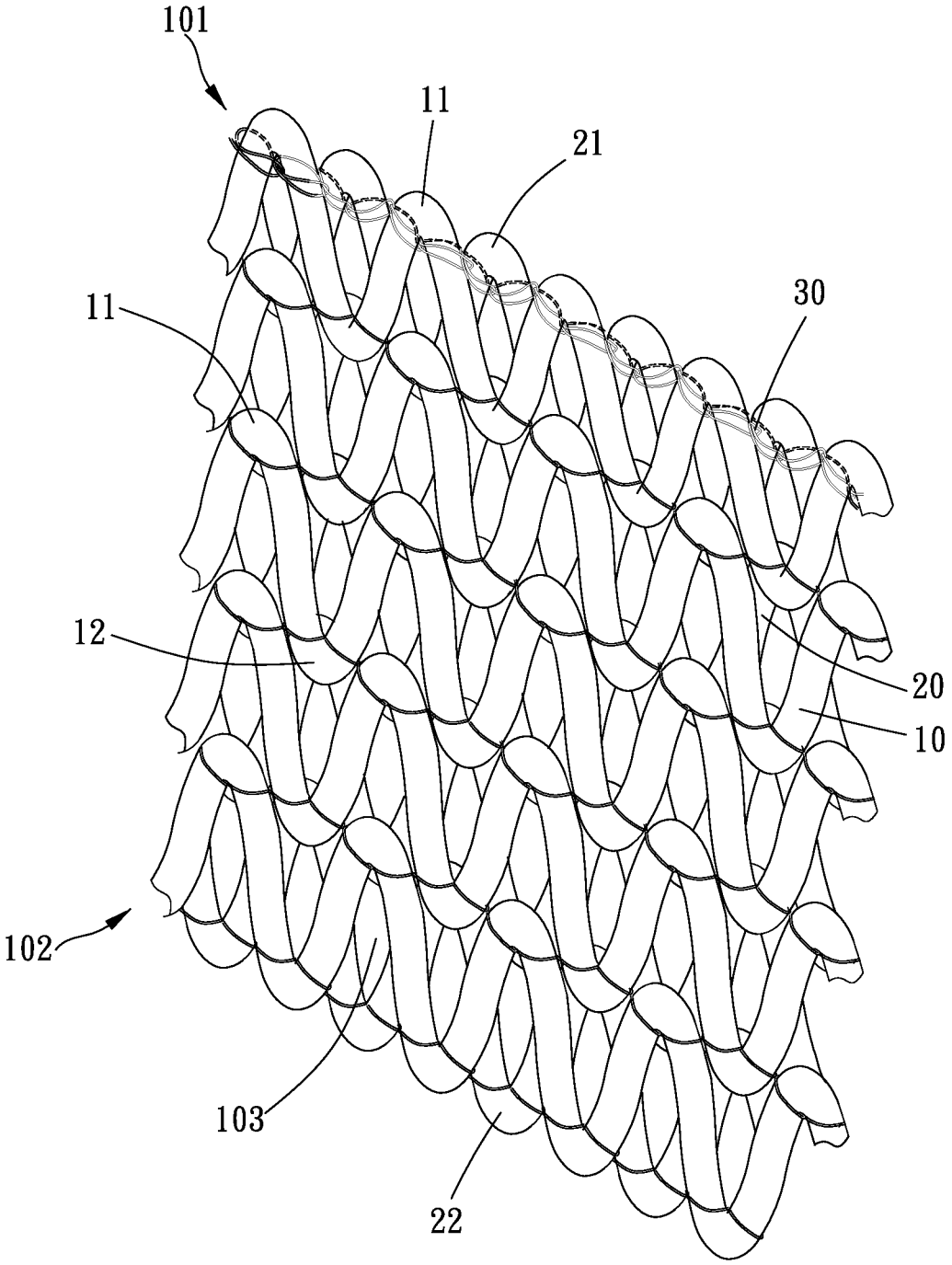
FIG. 1 is a stereogram of the present invention.
Figure 2:
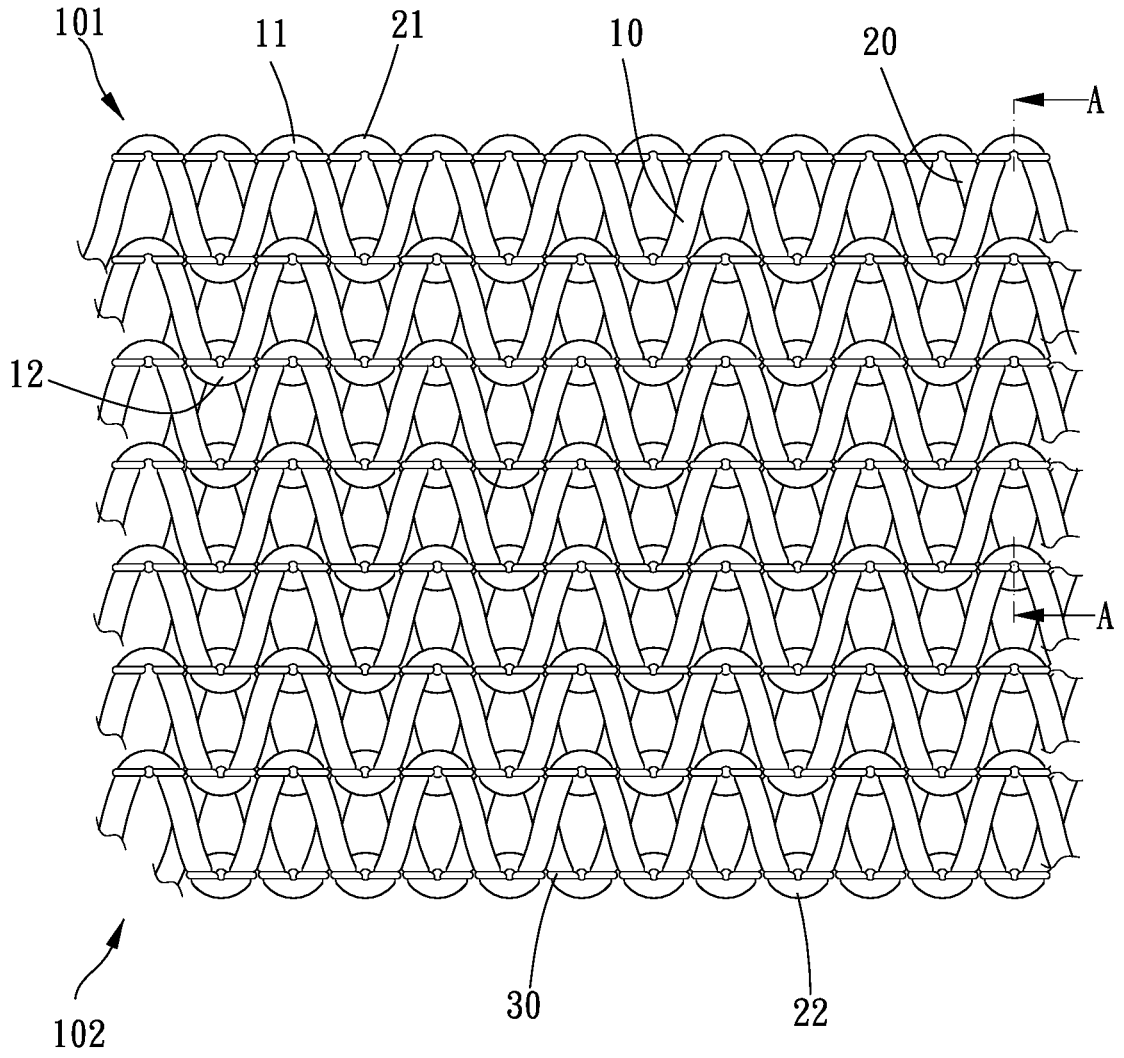
FIG. 2 is a top view of the present invention.
Figure 3:
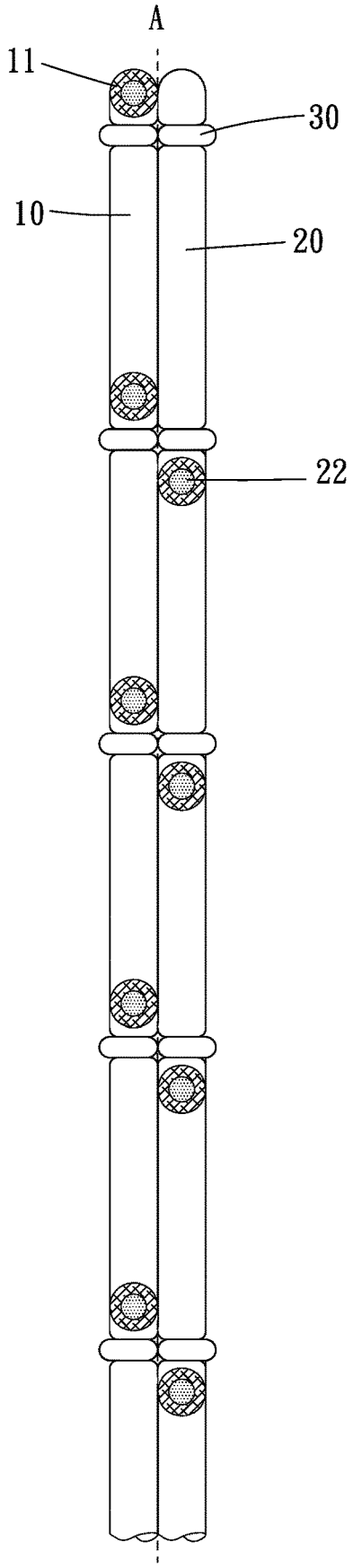
FIG. 3 is a lateral view of the present invention.
Figure 4:
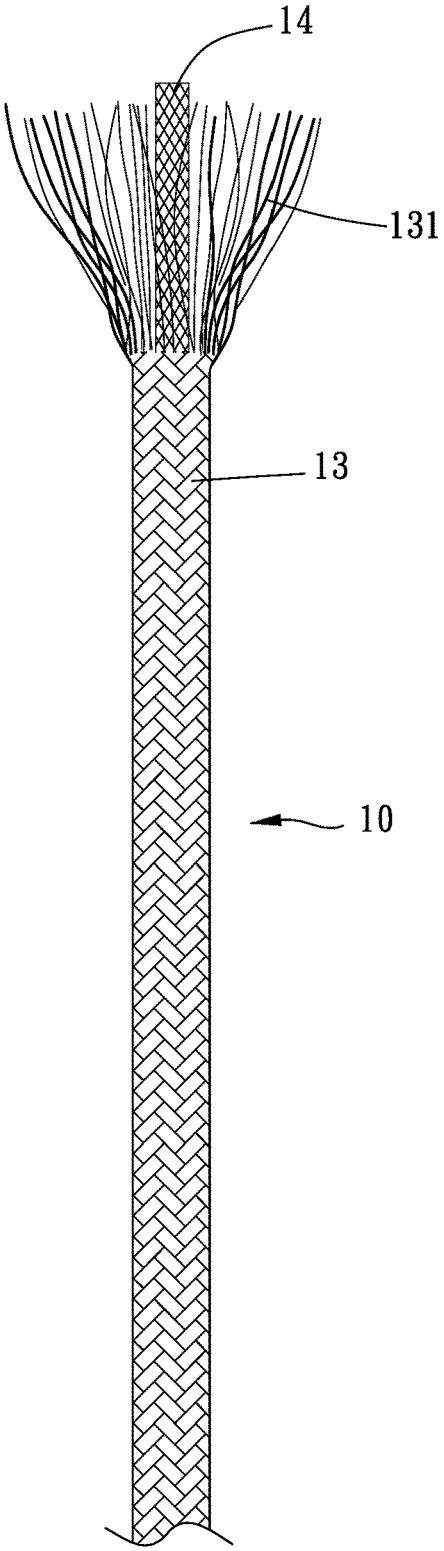
FIG. 4 is a breakdown drawing of a first braid of the present invention.

Please refer to FIGS. 1 to 4, the woven textile of the present invention defines an imaginary plane A and has a first end 101 and an opposite second end 102. A longitudinal direction parallel to the imaginary plane A is defined by the first end 101 and the second end 102. The woven textile further defines a horizontal direction which is parallel to the imaginary plane A but perpendicular to the longitudinal direction. The woven textile includes an upper layer, a lower layer, and at least one binding thread 30.

The upper layer includes at least one first braid 10. The first braid 10 is woven by a plurality of filaments and extends in a meandering way to form a plurality of hollow portions. The upper layer and the lower layer are located at two opposite sides of the imaginary plane A and are stacked along a vertical direction perpendicular to the imaginary plane A. The lower layer includes at least one second braid 20. The second braid 20 is woven by a plurality of filaments and extends in a meandering way to form a plurality of hollow portions. The binding thread 30 fixes the first braid 10 and the second braid 20 together by weaving so that the upper layer and the lower layer are connected and fixed by the binding thread 30.

In the present embodiment, the upper layer includes a plurality of said first braids 10. The first braids 10 are aligned along the longitudinal direction. The lower layer includes a plurality of said second braids 20. The second braids 20 are aligned along the longitudinal direction. The woven textile includes a plurality of binding threads 30. Each binding thread 30 fixes at least one of the first braids 10 and at least one of the second braids 20 together by weaving. Preferably, each first braid 10 extends wavily to have a plurality of first crests 11 and a plurality of first troughs 12 arranged alternatively along the horizontal direction. The first crests 11 are closer to the first end 101 than the first troughs 12 are. The first troughs 12 are closer to the second end 102 than the first crests 11 are. Each second braid 20 extends wavily to have a plurality of second crests 21 and a plurality of second troughs 22 arranged alternatively along the horizontal direction. The second crests 21 are closer to the first end 101 than the second troughs 22 are. The second troughs 22 are closer to the second end 102 than the second crests 21 are. The first crests 11 of the first braids 10 are aligned along the longitudinal direction. The second crests 21 of the second braids 20 are aligned along the longitudinal direction. Each first crest 11 of each first braid 10 is located between two adjacent second crests 21 of one of the second braids 20 so that the first braids 10 are complementary to the second braids 20. Specifically, each first crest 11 of each first braid 10 is located between two adjacent first troughs 12 of the first braid 10 adjacent thereto. Each first trough 12 of each first braid 10 is located between two adjacent first crests 11 of the first braid 10 adjacent thereto. Each second crest 21 of each second braid 20 is located between two adjacent second troughs 22 of the second braid 20 adjacent thereto. Each second trough 22 of each second braid 20 is located between two adjacent second crests 21 of the second braid 20 adjacent thereto. Preferably, each of the first braids 10, the second braids 20, and the binding threads 30 extends along a horizontal direction. The horizontal direction is perpendicular to each of the longitudinal direction and the vertical direction.

Specifically, each of the first braids 10 and the second braids 20 is woven by braiding machine. Preferably, each first braid 10 includes an outer layer 13 and a core 14. The outer layer 13 is braided by a plurality of said filaments 131 to be tubular. The core 14 is inserted through the outer layer 13. Each second braid 20 includes an outer layer and a core. The outer layer is braided by a plurality of said filaments to be tubular. The core is inserted through the outer layer.

In addition, an overlapping area of the hollow portions of the upper layer and the hollow portions of the lower layer form a plurality of through holes 103. Each through hole 103 is surrounded by part of the first braid 10 and part of the second braid 20.

Practically, the first braids 10 can be a single braid, and the second braids 20 can be a single braid too. Also, the binding threads 30 can be a single thread.

Thereby, the upper layer and the lower layer can be manufactured independently to simplify the process of manufacture. In addition, the gap between the upper layer and the lower layer provides cushion and air-permeability. Besides, the complementary structure of the two layers makes larger through holes. On the other hand, the independent layers can be designed in various ways.

What is claimed is:

1. A woven textile, defining a longitudinal direction being defined by opposite ends of the woven textile and a horizontal direction which is perpendicular to the longitudinal direction, the woven textile including:

an upper layer, including at least one first braid, the first braid being woven by a plurality of filaments, the at least one first braid having a plurality of first crests and a plurality of first troughs arranged alternately along the horizontal direction, the at least one first braid forming a plurality of hollow portions among the first crests and the first troughs;

a lower layer, the upper layer and the lower layer being stacked along a vertical direction perpendicular to the horizontal direction and being positioned on opposite sides of the woven textile, the lower layer including at least one second braid, the second braid being woven by a plurality of filaments, the at least one second braid having a plurality of second crests and a plurality of second troughs arranged alternately along the horizontal direction, the at least one second braid form a plurality of hollow portions among the second crests and the second troughs;

at least one binding thread, tying around and radially constricting the first braid and the second braid so that the upper layer and the lower layer are connected and fixed by the binding thread;

wherein the upper layer includes a plurality of said first braids, the first braids are aligned along the longitudinal direction, the lower layer includes a plurality of said second braids, the second braids are aligned along the longitudinal direction, the woven textile includes a plurality of binding threads, each binding thread fixes at least one of the first braids and at least one of the second braids together by weaving;

wherein the first crests of the first braids are aligned along the longitudinal direction, the second crests of the second braids are aligned along the longitudinal direction;

wherein each first crest of each first braid is located between two adjacent second crests of one of the second braids so that the first braids are complementary to the second braids;

wherein each first crest of each first braid is located between two adjacent first troughs of the first braid adjacent thereto, each first trough of each first braid is located between two adjacent first crests of the first braid adjacent thereto, each second crest of each second braid is located between two adjacent second troughs of the second braid adjacent thereto, each second trough of each second braid is located between two adjacent second crests of the second braid adjacent thereto;

wherein the plurality of first crests and the plurality of second crests are arranged alternately along the horizontal direction, and the plurality of first troughs and the plurality of second troughs are arranged alternately along the horizontal direction;

wherein each of the plurality of first crests is connected with only one of the plurality of second troughs by the binding thread, and each of the plurality of first troughs is connected with only one of the plurality of second crests by the binding thread.

2. The woven textile of claim 1, wherein each of the first braids and the second braids is woven by braiding machine.

3. The woven textile of claim 1, wherein each first braid includes an outer layer and a core, the outer layer is braided by a plurality of said filaments to be tubular, the core is inserted through the outer layer, each second braid includes an outer layer and a core, the outer layer is braided by a plurality of said filaments to be tubular, the core is inserted through the outer layer.

4. The woven textile of claim 1, wherein an overlapping area of the hollow portions of the upper layer and the hollow portions of the lower layer form a plurality of through holes, each through hole is surrounded by part of the first braid and part of the second braid.

* * * * *